US007665828B2

(12) United States Patent
Stevenson et al.

(10) Patent No.: US 7,665,828 B2
(45) Date of Patent: Feb. 23, 2010

(54) DROP GENERATOR

(75) Inventors: James M. Stevenson, Tualatin, OR (US); Bradley J. Gerner, Rochester, NY (US); Dan L. Massopust, Powell Butte, OR (US)

(73) Assignee: Xerox Corporation, Norwalk, CT (US)

( * ) Notice: Subject to any disclaimer, the term of this patent is extended or adjusted under 35 U.S.C. 154(b) by 422 days.

(21) Appl. No.: 11/524,605

(22) Filed: Sep. 21, 2006

(65) Prior Publication Data

US 2008/0074478 A1 Mar. 27, 2008

(51) Int. Cl.
*B41J 2/045* (2006.01)

(52) U.S. Cl. ..... 347/68

(58) Field of Classification Search ..... 347/68–72
See application file for complete search history.

(56) References Cited

U.S. PATENT DOCUMENTS 5,406,318 A * 4/1995 Moore et al. ..... 347/70
2002/0089574 A1 * 7/2002 Yamauchi et al. ..... 347/69

FOREIGN PATENT DOCUMENTS

WO WO 2004/110768 A1 * 12/2004

* cited by examiner

*Primary Examiner*—Stephen D Meier
*Assistant Examiner*—Geoffrey Mruk
(74) *Attorney, Agent, or Firm*—Fay Sharpe LLP

(57) ABSTRACT

A drop generator including a fluid channel substructure having a pressure chamber and an inlet formed therein, a diaphragm layer overlying the fluid channel substructure, a transducer substructure attached to the diaphragm layer, and an ink feed aperture formed in the diaphragm layer.

20 Claims, 1 Drawing Sheet

DROP GENERATOR

BACKGROUND

The subject disclosure is generally directed to drop emitting apparatus including, for example, drop jetting devices.

Drop on demand ink jet technology for producing printed media has been employed in commercial products such as printers, plotters, and facsimile machines. Generally, an ink jet image is formed by selective placement on a receiver surface of ink drops emitted by a plurality of drop generators implemented in a printhead or a printhead assembly. For example, the printhead assembly and the receiver surface are caused to move relative to each other, and drop generators are controlled to emit drops at appropriate times, for example by an appropriate controller. The receiver surface can be a transfer surface or a print medium such as paper. In the case of a transfer surface, the image printed thereon is subsequently transferred to an output print medium such as paper.

DETAILED DESCRIPTION

Figure 1:
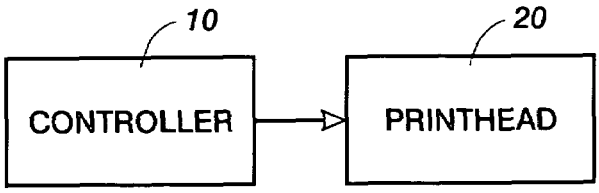
FIG. 1 is a schematic block diagram of an embodiment of a drop-on-demand drop emitting apparatus.

FIG. 1 is a schematic block diagram of an embodiment of a drop-on-demand printing apparatus that includes a controller 10 and a printhead assembly 20 that can include a plurality of drop emitting drop generators. The controller 10 selectively energizes the drop generators by providing a respective drive signal to each drop generator. Each of the drop generators can employ a piezoelectric transducer. By way of illustrative example, the printhead assembly 20 can be formed of a stack of laminated sheets or plates, such as of stainless steel.

Figure 2:
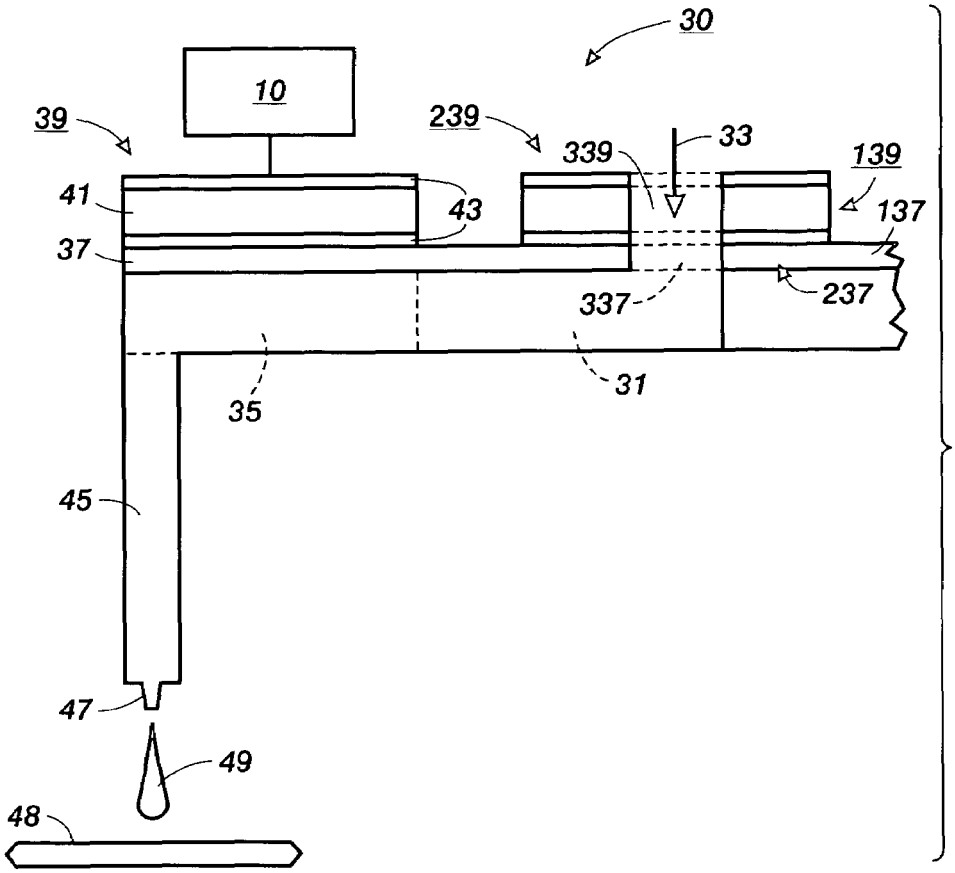
FIG. 2 is a schematic block diagram of an embodiment of a drop generator that can be employed in the drop emitting apparatus of FIG. 1.

FIG. 2 is a schematic block diagram of an embodiment of a drop generator 30 that can be employed in the printhead assembly 20 of the printing apparatus shown in FIG. 1. The drop generator 30 includes an ink pressure or pump chamber 35 that is bounded on one side, for example, by a flexible diaphragm 37. A piezoelectric transducer 39 is attached to the flexible diaphragm 37 and can overlie the pressure chamber 35, for example. The piezoelectric transducer 39 can comprise a piezo element 41 disposed, for example, between electrodes 43 that receive drop firing and non-firing signals from the controller 10. If the diaphragm 37 is made of a conductive material, it can comprise an electrode of the piezoelectric transducer.

The drop generator further includes an ink feed inlet 31 that is connected to the pressure chamber 35 and can be formed in a fluid channel substructure 131 (FIG. 3) that can implement the pressure chamber 35. A first ink feed aperture 339 and a second ink feed aperture 337 are in fluidic communication with the ink feed inlet 31. More particularly, the ink feed aperture 339 can be formed in an ink feed portion 239 of a transducer substructure 139 that can implement the transducer 39, wherein the ink feed portion of the transducer layer 139 can be adjacent the piezoelectric transducer 39. The second ink feed aperture 337 can be formed in an ink feed portion 237 of a diaphragm layer 137 which can implement the diaphragm plate 37, wherein the ink feed portion of the diaphragm layer 137 can be adjacent the diaphragm 39. The second ink feed aperture 337, the first ink feed aperture 339, and the ink feed inlet 31 overlap at least partially such that ink 33 can flow through the ink feed apertures 339, 337 and the ink feed inlet 31, and into the pressure chamber 35.

It should be appreciated that for an ink chamber 35 there can be a plurality of ink feed apertures 339 in the transducer substructure 139, and that there can be a plurality of ink feed apertures in the diaphragm layer 137, wherein the number of ink feed apertures 239 in the transducer substructure 139 can be different from the number of ink feed apertures 237 in the diaphragm layer 137. For example, two ink feed apertures 339 in the transducer substructure 139 can feed one ink feed aperture 337 in the diaphragm layer 137.

Ink 33 can be provided to the ink feed apertures by a suitable manifold structure.

By way of illustrative example, the ink feed aperture(s) 339 in the transducer substructure 139 can be made by laser machining, such as laser drilling, and can have a diameter in the range of about 50 microns to about 500 microns. The ink feed apertures 337 in the diaphragm layer 137 can also be made by laser machining such as laser drilling.

Actuation of the electromechanical transducer 39 causes ink to flow from the pressure chamber 35 through an outlet channel 45 to a drop forming nozzle or orifice 47, from which an ink drop 49 is emitted toward a receiver medium 48 that can be a transfer surface, for example.

The ink 33 can be melted or phase changed solid ink, and the electromechanical transducer 39 can be a piezoelectric transducer that is operated in a mode of deformation, for example. The ink 33 can also be ambient temperature ink.

Figure 3:
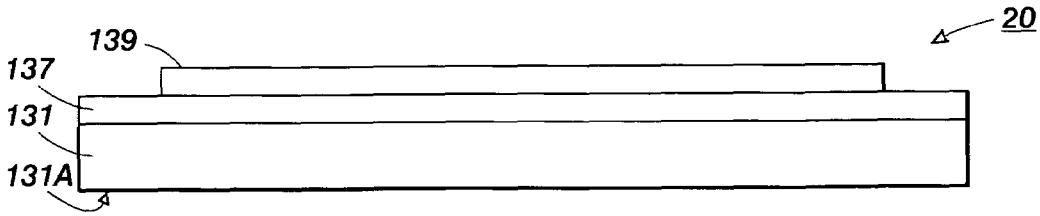
FIG. 3 is a schematic elevational view of an embodiment of an ink jet printhead assembly.

FIG. 3 is a schematic elevational view of an embodiment of an ink jet printhead assembly 20 that can implement a plurality of drop generators 30 (FIG. 2) as an array of drop generators. The ink jet printhead assembly includes a fluid channel layer or substructure 131, a diaphragm layer 137 attached to the fluid channel layer 131, and a transducer substructure 139 attached to the diaphragm layer 137. The fluid channel substructure 131 implements the ink feed inlets and pressure chambers of the drop generators 30, while the diaphragm layer 137 implements the diaphragms 37 of the drop generators as well as ink feed apertures 337. The transducer substructure 139 implements the piezoelectric transducers 39 of the drop generators 30, as well as ink feed apertures 339. The ink feed portions of the transducer substructure 139 can comprise waste portions remaining after a laminar electrode/piezo/electrode structure is diced to form individual piezoelectric transducers. It should be appreciated that ink can be provided directly to the ink feed apertures 237 in the diaphragm layer if such waste portions are removed or not formed, for example in an implementation wherein the piezoelectric transducers 39 are formed by screen printing. The nozzles of the drop generators 30 are disposed on an outside surface 131A of the fluid channel layer 131 that is opposite the diaphragm layer 137, for example.

By way of illustrative example, the diaphragm layer 137 comprises a metal plate or sheet, such as stainless steel, that is attached or bonded to the fluid channel layer 131. As further examples, the diaphragm layer 137 can comprise back etched silicon or an electroformed structure. Also by way of illustrative example, the fluid channel substructure 131 can comprise a laminar stack of plates or sheets, such as stainless steel.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A drop generator comprising:

a piezoelectric transducer comprised of a piezoelectric element located between an upper electrode and a lower electrode;

a flexible diaphragm layer located below the piezoelectric transducer;

a fluid channel substructure located below the diaphragm layer having a pressure chamber and an inlet to the pressure chamber formed therein, wherein the fluid channel is at least twice the length of the width or height of the channel;

an ink feed aperture formed in the diaphragm plate; and an ink feed aperture formed in the transducer substructure and located adjacent to the piezoelectric; and a drop forming nozzle located at the end of an outlet channel which extends below the diaphragm layer, wherein the nozzle is not contained within the body of the printhead.

2. The drop generator of claim 1 wherein the diaphragm layer comprises stainless steel.

3. The drop generator of claim 1 wherein the fluid channel substructure comprises a thin, flat flexible stack of metal plates.

4. The drop generator of claim 1 wherein the ink feed aperture in the transducer substructure has a diameter less than 30 microns.

5. The drop generator of claim 1 wherein the ink feed aperture has a diameter in the range of about 150 microns to about 500 microns.

6. The drop generator of claim 1 further including phase change of ink from a solid ink to a liquid ink disposed in the pressure chamber.

7. A drop generator comprising:

a fluid channel substructure having a pressure chamber and an inlet to the pressure chamber formed therein;

a flexible diaphragm layer overlying the fluid channel substructure;

a transducer substructure attached to the diaphragm layer and located between an upper electrode and a lower electrode;

an ink feed aperture formed in the diaphragm plate; and an ink fed aperture formed in the transducer substructure.

8. The drop generator of claim 7 wherein the diaphragm layer comprises stainless steel.

9. The drop generator of claim 7 wherein the fluid channel substructure comprises a thin, flat flexible stack of metal plates.

10. The drop generator of claim 7 wherein the ink feed aperture in the diaphragm layer has a diameter of less than 30 microns.

11. The drop generator of claim 7 further including phase change ink disposed in the pressure chamber from a solid state to a liquid state.

12. A drop generator for drop-on-demand printing comprising:

a piezoelectric transducer layer comprised of a piezoelectric element located between an upper electrode an a lower electrode;

a flexible diaphragm layer located below the piezoelectric transducer;

a fluid channel substructure located below the diaphragm layer having a pressure chamber and an inlet into the pressure chamber;

a plurality of ink feed apertures in the diaphragm layer, where each aperture is fed ink by more than one apertures in the transducer layer; and a nozzle at the end of an outlet channel which extends below the diaphragm layer, wherein the nozzle is not contained within the body of the printhead.

13. The drop generator of claim 12 wherein the diaphragm layer comprises stainless steel.

14. The drop generator of claim 12 wherein the fluid channel substructure comprises thin, flat flexible metal plates.

15. The drop generator of claim 12 wherein the ink feed aperture in the transducer substructure has a diameter less than 30 microns.

16. The drop generator of claim 12 wherein the ink feed aperture has a diameter in the range of about 150 microns to about 500 microns.

17. The drop generator of claim 12 further including phase change of the ink disposed in the pressure chamber from a solid to a liquid.

18. The drop generator of claim 12 further including ink portions of the transducer substructure can comprise a plurality of individual piezoelectric transducers.

19. The drop generator of claim 12 wherein the diaphragm layer comprises back etched silicon or an electroformed structure.

20. The drop generator of claim 12 wherein the piezoelectric element receives drop signals from a controller.

* * * * *